US010641564B2

(12) United States Patent
Schneider

(10) Patent No.: US 10,641,564 B2
(45) Date of Patent: May 5, 2020

(54) WEAPON DRIVE AND WEAPON DRIVE WITH AN EMERGENCY WEAPON STOP

(71) Applicant: RHEINMETALL WAFFE MUNITION GMBH, Unterluess (DE)

(72) Inventor: Hubert Schneider, Dietingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 14 days.

(21) Appl. No.: 15/867,354

(22) Filed: Jan. 10, 2018

(65) Prior Publication Data

US 2018/0231338 A1 Aug. 16, 2018

Related U.S. Application Data

(63) Continuation of application No. PCT/EP2016/065858, filed on Jul. 5, 2016.

(30) Foreign Application Priority Data

Jul. 10, 2015 (DE) ..... 10 2015 008 798
Jul. 10, 2015 (DE) ..... 10 2015 012 981

(51) Int. Cl.
*F41A 7/08* (2006.01)
*F41A 17/18* (2006.01)

(52) U.S. Cl.
CPC ..... *F41A 7/08* (2013.01); *F41A 17/18* (2013.01)

(58) Field of Classification Search
CPC ..... F41A 7/08; F41A 17/18
USPC ..... 89/11
See application file for complete search history.

(56) References Cited

U.S. PATENT DOCUMENTS 4,357,857 A * 11/1982 Magnuson ..... F41A 9/45 89/156
4,418,607 A * 12/1983 Price ..... F41A 9/30 89/11
4,481,858 A * 11/1984 Price ..... F41A 9/30 89/11
4,697,496 A * 10/1987 Goldin ..... F41A 9/35 89/1.41
5,353,678 A * 10/1994 Rochelle ..... F41A 9/45 89/33.03

(Continued)

FOREIGN PATENT DOCUMENTS

DE 10 2006 022 622 A1 11/2007
DE 10 2007 048 468 A1 4/2009

(Continued)

*Primary Examiner* — Michelle Clement
(74) *Attorney, Agent, or Firm* — Muncy, Geissler, Olds & Lowe, P.C.

(57) ABSTRACT

A drive for a weapon having a drive cam and a connecting rod unit guided in the drive cam. The drive cam includes the firing cycle of the weapon. A connecting rod unit has a front pin and a rear pin, a strut pin. With its front pin, the connecting rod unit engages in the drive cam. The front pin is also connected to a crank, which is driven by an external drive. The strut pin is connected to an overall control slider of a breech block of the weapon. An emergency stop device, which when a shot is fired makes a pin extend and ensures that the overall control slider is taken along. If, on the other hand, no shot is fired, the pin is not made to extend and the overall control slider not moved. Parts of the drive may in this case continue to run.

13 Claims, 6 Drawing Sheets

(56) References Cited

U.S. PATENT DOCUMENTS

| | | | | |
|---|---|---|---|---|
| 8,297,167 | B2 * | 10/2012 | Hoffman | F41A 7/08 89/1.4 |
| 8,402,874 | B2 * | 3/2013 | Herrmann | F41A 7/08 89/18 |
| 8,413,565 | B2 * | 4/2013 | Herrmann | F41A 7/08 42/14 |
| 8,479,633 | B2 * | 7/2013 | Herrmann | F41A 7/08 89/17 |
| 8,616,112 | B2 * | 12/2013 | Herrmann | F41A 7/08 89/20.4 |
| 8,726,779 | B2 * | 5/2014 | Buhl | F41A 7/08 89/11 |
| 10,365,054 | B2 * | 7/2019 | Schneider | F41A 17/18 |
| 2011/0290103 | A1 * | 12/2011 | Herrmann | F41A 7/08 89/18 |
| 2011/0314996 | A1 * | 12/2011 | Herrmann | F41A 7/08 89/17 |
| 2012/0132061 | A1 * | 5/2012 | Herrmann | F41A 7/08 89/17 |
| 2012/0132062 | A1 * | 5/2012 | Herrmann | F41A 7/08 89/17 |
| 2012/0318127 | A1 * | 12/2012 | Buhl | F41A 7/08 89/33.01 |
| 2018/0231344 | A1 * | 8/2018 | Schneider | F41A 3/44 |

FOREIGN PATENT DOCUMENTS

| | | |
|---|---|---|
| DE | 10 2007 048 470 A1 | 4/2009 |
| DE | 10 2008 060 214 A1 | 6/2010 |
| DE | 10 2008 060 215 A1 | 6/2010 |
| DE | 10 2008 060 217 A1 | 6/2010 |
| DE | 10 2009 056 735 A1 | 6/2011 |

* cited by examiner

WEAPON DRIVE AND WEAPON DRIVE WITH AN EMERGENCY WEAPON STOP

This nonprovisional application is a continuation of International Application No. PCT/EP2016/065858, which was filed on Jul. 5, 2016, and which claims priority to German Patent Application Nos. 10 2015 008 798.3 and 10 2015 012 981.3, which were filed in Germany on Jul. 10, 2015, and which are herein incorporated by reference.

BACKGROUND OF THE INVENTION

Field of the Invention

The present invention relates to a drive for an externally driven weapon, and to a weapon quick stop or emergency stop when a shot is not fired.

Description of the Background Art

DE 10 2006 022 622 A1 discloses a function controller for the linear feeding of a munition in a weapon barrel. The drive itself is a revolving chain.

A further drive is disclosed by DE 10 2007 048 468 A1. The function controller for the idle times of the weapon and thus of the breech is defined, here too, by a control link which is located in a horizontal plane parallel to the breech, and a drive link which is oriented parallel to the control link.

DE 10 2008 060 214 A1, which corresponds to U.S. Pat. No. 8,479,633, describes a crank drive for an externally driven weapon. In order to realize idle times of the breech in the end positions, the connecting rod and crank are arranged so as to be radially displaceable relative to one another, such that the crank radius changes upon rotation of the crank. The radial guidance of the connecting rod is carried out by a control curve.

DE 10 2008 060 217 A1, which corresponds to U.S. Pat. No. 8,616,112, publishes a drive having a control curve in the crank housing, said control curve being subdivided into different regions/sectors in order to set the desired movements of the breech and also the idle times.

DE 10 2007 048 470 A1 discloses a quick stop incorporated into a drive, for example a chain, said quick stop activating a deflector on the opposite side in the feed of the breech of the weapon and engaging in the drive path of the chain. When a shot has been fired and thus a recoil of the weapon or weapon housing has occurred, the deflector is deactivated again and the drive can continue to run in an uninterrupted manner. If, however, a shot is not fired, the deflector remains in its position. The drive cam runs up to the deflector and stops. The deflector is for its part constructed, for example buffered, such that destruction of the drive and of the deflector is avoided.

DE 10 2008 060 215 A1, which corresponds to U.S. Pat. No. 8,402,874, describes a drive having a quick stop. When a shot is fired, the recoiling masses cause a carriage to move such that the cam of the drive carries along the breech (or breech carrier) in its rearward movement. In the event that there is a dud and there is no recoil, the carriage remains in its position and the cam of the drive runs toward the rear without the breech.

SUMMARY OF THE INVENTION

It is therefore an object of the present invention to provide a drive and an emergency stop contained therein for a weapon.

In an exemplary embodiment, the invention is based on the idea of providing a drive with a sufficiently long dead point or a long dead time (idle times) of a breech at least during firing and weapon recoil. As a consequence of this idea, a weapon of narrow design is advantageously created. An emergency stop contained therein, or the quick stop device, is designed in this case such that the drive can continue to run as such in an unimpeded manner, even when a shot has not been fired (dud). Possible damage to the drive is precluded as a result.

The drive has a drive curve in which a connecting rod is guided. The drive curve defines the firing cycle of the weapon and thus the idle times of the breech. In the front position (as seen in the firing direction), the breech is deactivated and locked. After a shot has been fired, the breech is unlocked, transferred into its rear position, the empty shell casing is guided out and the latter then ejected. In the rear position, the breech is again deactivated and a new munition is introduced into the weapon. The basic principle of the breech movement, of deactivation, locking and triggering of firing etc., is described in detail in DE 10 2008 060 217 A1, which corresponds to U.S. Pat. No. 8,616,112, and which is incorporated herein by reference.

In the times in which the breech is at rest in the weapon system, i.e. in which it is deactivated, the front pin of the connecting rod runs in that part or region of the drive curve that extends in each case transversely to the weapon and the breech. The radius of said part or region is as great as the length (bearing) of the connecting rod guided in the drive curve. The run-in/run-out curves of the two radii are selected to be small in order to achieve a quick response of the respective action with regard to the breech, for instance quick deactivation of the breech or quickly initiated returning of the breech etc. Contained between the pin of the connecting rod and the drive curve is a crank, which allows the nonround running of the pin.

The connecting rod comprises, in addition to this front pin, a rear driver and is mounted in a pivotable manner at a pivot point located behind the rear driver. The front pin runs in the drive curve of the breech. The rear driver is guided in a groove incorporated transversely in the breech slide. The pivot point, located behind the driver, of the connecting rod pivots the driver of the connecting rod to the right/left such that the driver travels in the groove of the breech or the carrier thereof. This construction allows the design of the drive curve as described. The drive curve and also the weapon can thus be designed in a narrow manner.

The rear pivotable driver of the connecting rod acts on an overall control slide which serves as a carrying slide (carrier) of the breech. In this case, the rear driver is guided in a groove-like guide beneath the overall control slide.

In an embodiment, an emergency stop device is contained in the drive. To this end, the drive device consists preferably of a fixed lug or a firm protrusion on the overall control slide, said lug or protrusion reaching across the entire width of the overall control slide, and of a movable cross slide which is guided for example in a T-slot in the overall control slide. In order to advance the breech, the driver acts on the firm lug in order to carry along the breech, and when the breech is returned, acts on the movable cross slide in order to transfer the breech into its rear position when a shot has been fired. To this end, the cross slide is pushed into a position in which the driver can carry along the slide, together with the breech, into the rear position. By contrast, if a shot is not fired, transport of the overall control slide is precluded. The pushing or lack of pushing of the cross slide is carried out in this case preferably by the pivotable connecting rod itself.

The movable cross slide for its part has a recess. If a shot is fired, the movable cross slide is displaced and thus also the recess. The recess remains without effect, the driver in contact with the side face in front of the recess. If, however, no shot is detected (for example a dud), the driver slides through this recess that has now not been displaced and thus away to the rear. The breech remains in its front, locked position. The carrying along or lack of carrying along is thus controlled by the emergency stop device.

The emergency stop device includes a pin and a kinematic system which retracts the pin when a shot has been fired, but avoids retraction such that, when a shot has not been fired, the breech is not transported to the rear.

The pin of the drive is incorporated into the overall control slide of the breech for displacement or non-displacement. If the shot has been fired, the pin is forced into the path of the driver by the recoil such that the driver displaces the pin and the movable cross slide to the side. In the process, the driver and cross slide overlap areally such that the connecting rod or the driver and the movable cross slide carry along the overall control slide. In the further movement of the movable cross slide and of the overall control slide, the pin is forced in again and the cross slide is transferred into its original position again. This can take place by way of slopes or ramps etc. incorporated into the main weapon housing or a weapon cradle. If, by contrast, no shot is detected, the pin is not forced out and remains in its original position. The driver or a part thereof then slides through under the pin and leaves the movable cross slide where it is. Consequently, the driver is oriented with respect to the recess in the cross slide and is guided in its rearward movement by the recess in the cross slide, such that the driver cannot carry along the breech.

In an embodiment, the driver of the connecting rod is mounted in the connecting rod in a spring-loaded manner. The movable cross slide additionally has a slope. This has the advantage that the driver is guided along the slope and can dip under the movable cross slide on account of the spring-loading. Subsequently, the driver can act on the fixed lug. This constructive variant has the great advantage that the drive can continue to run when no recoil has occurred. If the driver encounters the drive device of the breech, it slides through under the cross slide of the drive device, along the fixed lug and out of the drive device again through the recess in the cross slide. Mechanical stopping does not occur with this construction. This constructive solution also has the advantage that, by way of a reversing movement of the drive (change in direction), the movable cross slide can additionally be used to extract the dud from the weapon barrel in a controlled manner. To this end, the driver acts on the surface of the cross slide from behind and carries the breech along.

Proposed is an emergency stop device which is formed by a kinematic system which forces out a pin when a shot is fired and ensures that the overall control slide is carried along. By contrast, if the shot is not fired, the pin is not forced out and the overall control slide is not moved. Parts of the drive can continue to run in the process. Also proposed is a drive for a weapon, having a drive curve and a connecting rod guided in the drive curve, wherein the drive curve includes the firing cycle of the weapon. The connecting rod comprises, in addition to a connecting rod shaft, a front pin and a rear pin, a driving pin. With its front pin, the connecting rod engages in the drive curve. The front pin is additionally connected to a crank which is driven by an external drive. The driving pin is connected to an overall control slide of a breech of the weapon. A connecting rod slide of the connecting rod has a groove in which the driving pin is guided and is articulated at a pivot point which is located behind the driving pin, such that the driving pin is pivoted in the groove in the connecting rod and in the overall control slide during the idle times of the breech.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
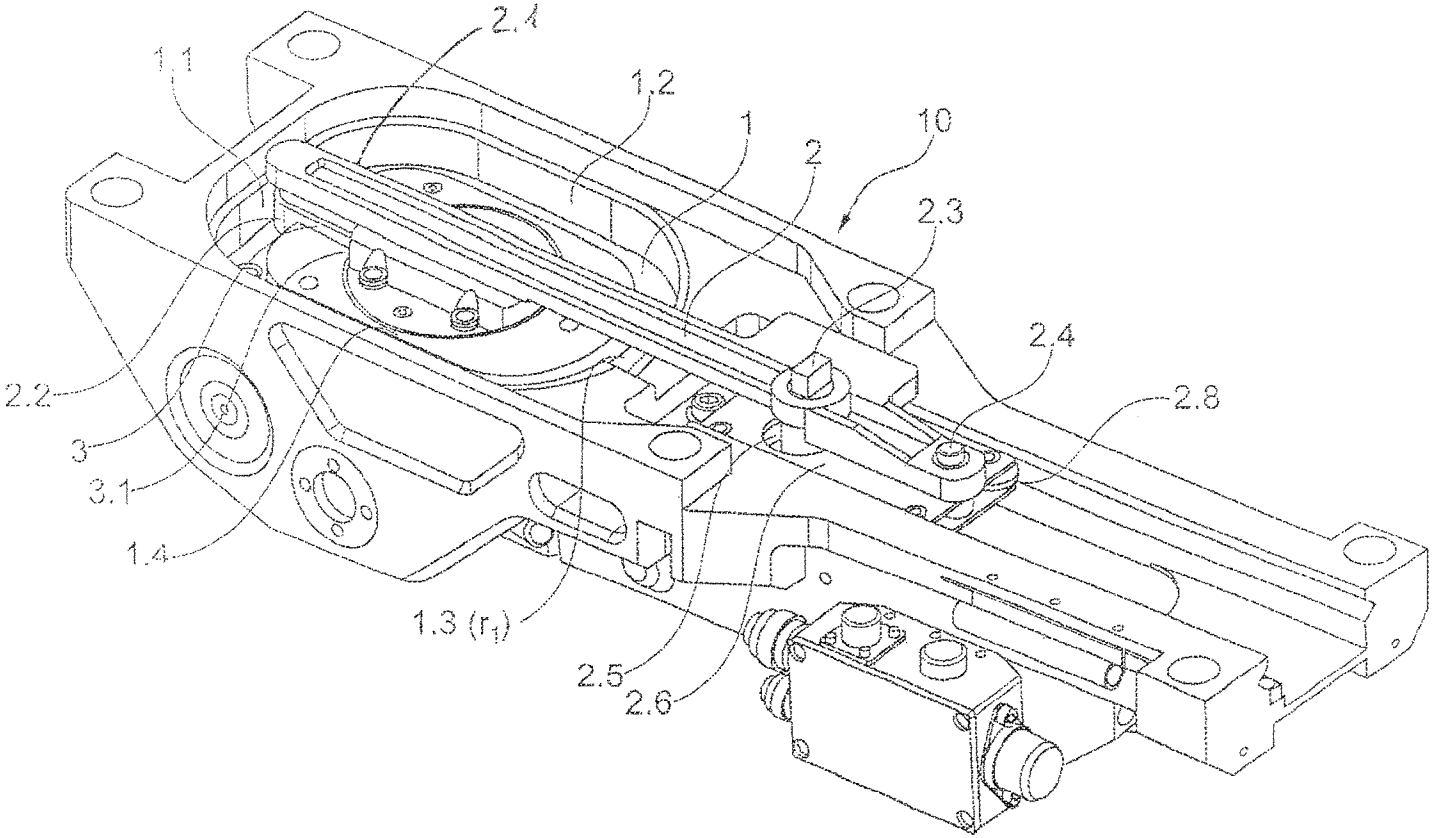
FIG. 1 shows a perspective plan-view illustration of a breech drive in an externally driven weapon.
Figure 2:
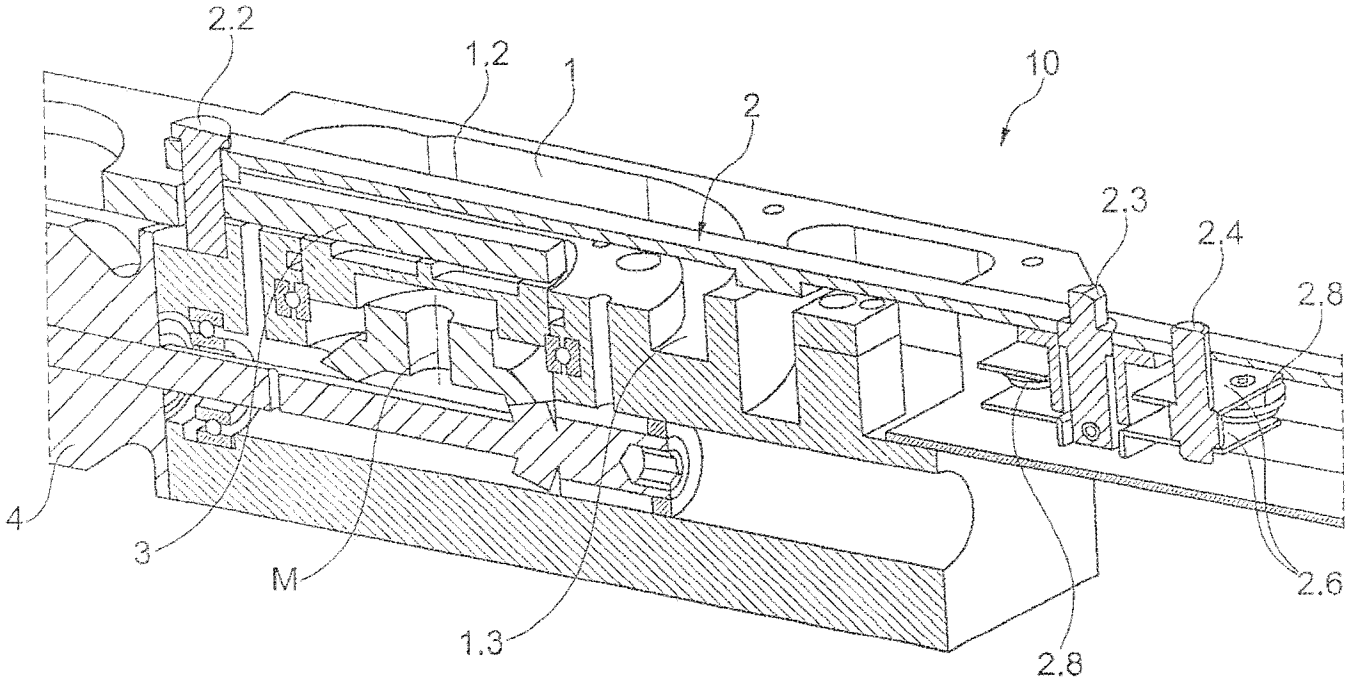
FIG. 2 shows a sectional illustration of the drive.

FIGS. 1 and 2 show a drive 10 for a weapon 100 (illustrated in part in FIG. 8), having a drive curve 1 and a connecting rod 2 guided in the drive curve 1. The drive curve 1 includes the firing cycle of the weapon 100, i.e. the idle times of a breech 11 of the weapon 10. It is nonround in the preferred embodiment. The drive curve 1 is subdivided into four regions 1.1-1.4. The front region 1.1, as seen in the firing direction, that extends approximately transversely to the breech 11 sets the idle times of the breech 11 in its front position locked to a weapon barrel (breech 11 at the front). In the rear region 1.3, which is formed here by a radius $r_1$, the breech 11 is at the rear (breech 11 at the rear). As a result, the dead time of the breech 11 in the rear position is influenced. The lateral straight regions 1.2, 1.4 define the forward movement and the rearward movement, respectively, of the breech 11 after the desired function. By way of the shape of the drive curve 1, the movement profiles of the breech 11 and the duration of the waiting times (idle times) in the reversing positions of the breech 11 are defined.

The connecting rod 2 has, in addition to a connecting rod shaft 2.1, a front pin 2.2, a rear pin 2.3 and a pivot point 2.4 located behind the latter. In this case, the connecting rod 2 engages with its front pin 2.2 (as seen in the firing direction) in the drive curve 1 and is moved therein. The front pin 2.2 is connected to a crank 3, which is driven by an external drive 4 (not illustrated in more detail). The crank 3, which is driven about a center M, moves the pin 2.2. The crank 3 is for its part contained in a groove 3.1 in which the crank 3 can slide in order in this way to be able to guide the front pin 2.2 of the connecting rod 2 in the nonround drive curve 1. The connecting rod 2, or the connecting rod shaft 2.1, is pivoted about the pivot point 2.4 within the idle times of the breech 11, this causing the rear pin 2.3 to pivot, which runs in a groove 2.5 in the connecting rod carriage 2.6 of the connecting rod 2. The connecting rod carriage 2.6 preferably has four sliding rollers 2.8, incorporated at the corners of the connecting rod carriage 2.6, for smooth sliding of the connecting rod 2 in the housing of the drive 10.

An overall control slide 12 (FIG. 3) preferably comprises two control curves 12.3 and 12.4, wherein the front control curve 12.3 includes deactivation and locking of the breech 11. The rear control curve 12.4 serves to release a firing pin (not illustrated in more detail) integrated into the breech 11. In this control curve 12.4, a further, in this case U-shaped connecting rod 12.5 is guided, which engages from above in a recess 11.1 in the breech 11 or in the breech head. When the breech 11 has been locked in its front, deactivated position by the breechblock (not illustrated in more detail) forced up by means of the front control curve 12.3, the firing pin is released by the second control curve 12.4. To this end, the connecting rod 12.5 is guided out of the recess 11.1 along the rear, second control curve 12.4.

Incorporated in the bottom of the overall control slide 12 is a groove-like guide (not illustrated in more detail). The connecting rod 2 engages with its driving pin 2.3 in the groove-like guide in the overall control slide 12 in order to transport the breech 11 and can be pivoted therein about the pivot point 2.4 of the connecting rod 2.

Figure 3:
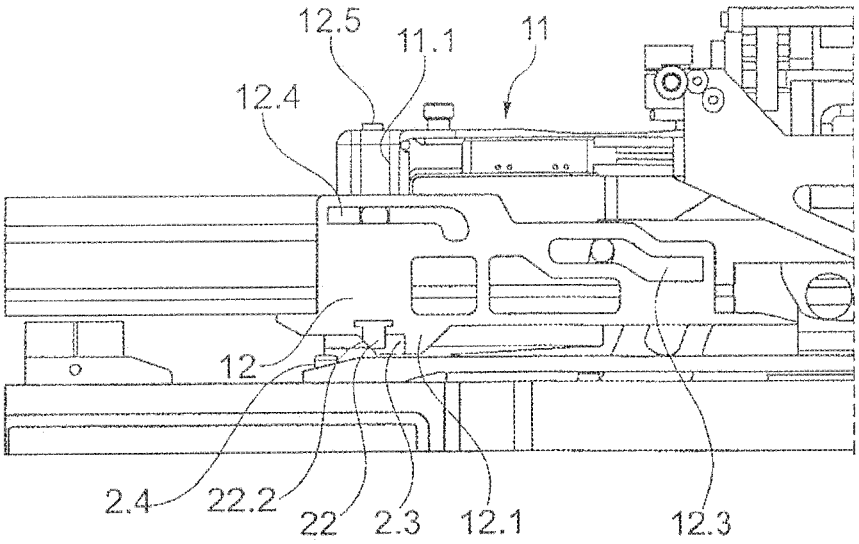
FIG. 3 shows a side view of the attachment of the breech drive from FIG. 1 to an overall control slide of the weapon.

FIG. 3 shows the breech 11 in its front position, when it is locked.

The breech 11 is transported as follows:

In order to transport the breech 11 from its rear position, in which a munition (not illustrated in more detail) is presented to the breech 11, the front pin 2.2 is in the rear region 1.3, as seen in the firing direction, with a radius $r_1$, of the drive curve 1. In order to transport the breech 11 into the front position, the driving pin 2.3 acts, as driver of the overall control slide 12, on the groove in the overall control slide 12. The radius $r_1$ is in this case preferably as large as the bearing of the connecting rod 2, with the result that a dead stroke of the connecting rod 2 is avoided. The overall control slide 12 serves as a carrying slide of the breech 11 (of the breech system). The front pin 2.2 is moved forward along the straight region 1.2 of the drive curve 1 and thus via the connecting rod 2 and driving pin 2.3 of the breech 11. In the process, the breech 11 carries along the munition (not illustrated in more detail) and feeds it to a weapon barrel (not illustrated in more detail) of the weapon 100. Once the front pin 2.2 reaches the front region 1.3, extending transversely to the weapon 100, of the drive curve 1, the breech 11 is deactivated upon entry into this region 1.1, the breech 11 is locked and a shot fired. In this phase, weapon recoil also takes place. The driving pin 2.3 is additionally pivoted in the groove 2.5 in the connecting rod and in the groove in the overall control slide 12. The oscillating movement of the connecting rod 2 in this region 1.1 is compensated for by the crank 3. When the front pin 2.2 passes out of the transversely extending region 1.1 of the drive curve 1 and into the straight region 1.4, the breech 11 is unlocked and the breech 11 is moved toward the rear by the driving pin 2.3 and the overall control slide 12. In the process, the breech 11 carries along the munition shell, which for its part is ejected. If the pin 2.2 runs back into the rear region of the drive curve 1.3, the breech 11 is deactivated, and as the pin 2.2 continues to run, the driving pin 2.3 is pivoted back in the groove 2.5 in the connecting rod 2 and the groove in the overall control slide 12.

In a particular embodiment, the drive 10 is provided with an emergency stop device 20 which prevents the breech 11 from being opened in the case of a dud or of a weapon fault. This emergency stop device 20 cooperates functionally and mechanically with parts of the drive 10. Instead of the groove-like guide or recess beneath the overall control slide 12, the overall control slide 12 now has a fixed lug 12.1 and a movable cross slide 22. Via the fixed lug 12.1, the breech 11, as described, is moved forward. The movable cross slide 22 serves to transport the breech 11 back (FIG. 3).

Figure 5:
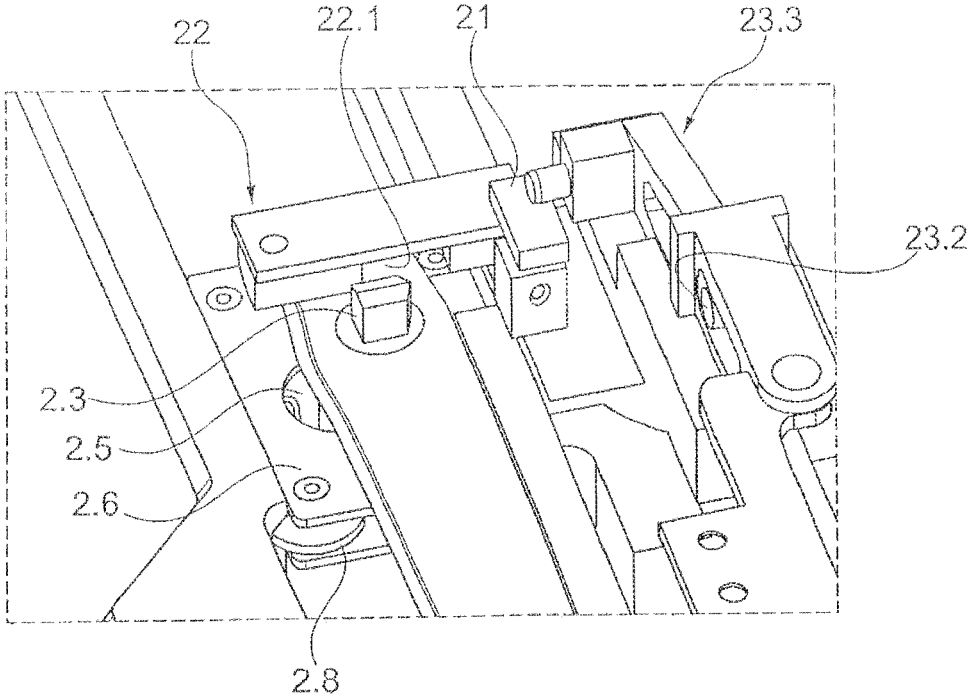
FIG. 5 shows a perspective plan-view illustration of the emergency stop device counter to the firing direction.
Figure 7A:
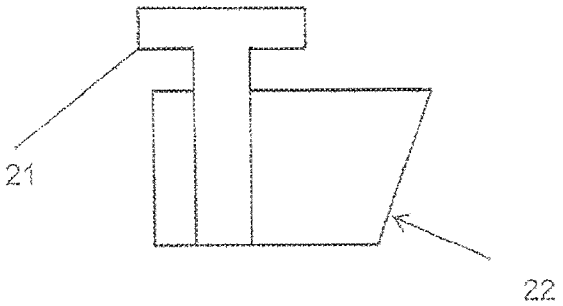
FIGS. 7*a* and 7*b* show an illustration of a pin, contained in the breech drive, in its original position and of the pin released by the emergency stop device.

The emergency stop device 20 includes a kinematic system 23 which is formed by at least one guide 23.1, at least one connecting rod 23.2 guided in the curve 23.1.1 of the guide 23.1, and at least one lever 23.3. This emergency stop device 20 cooperates with a pin 21 which ensures that the cross slide 22 is carried along when a shot is fired and prevents this when a shot is not fired. This pin 21 is contained in the cross slide 22 (FIG. 7*a*). The movable cross slide 22 for its part has a recess 22.1 (FIG. 5). The driving pin 2.3 overlaps the cross slide 22 in the region in front of the recess 22.1.

Figure 6:
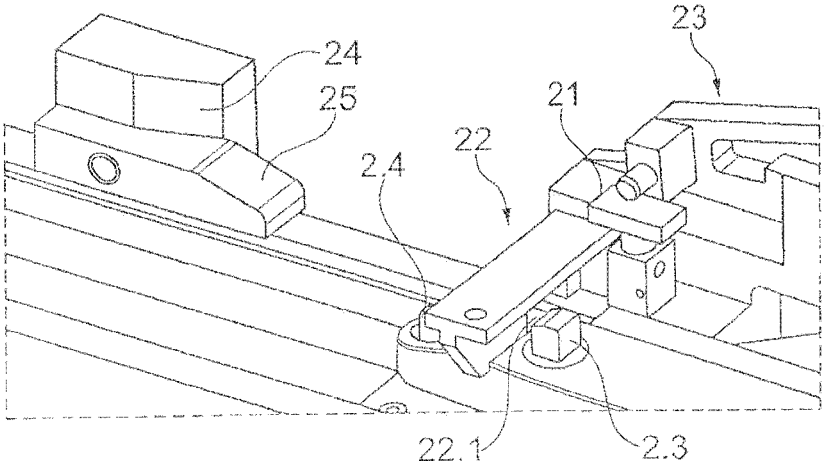
FIG. 6 shows an illustration of the emergency stop device in a perspective side view.

If a shot is fired, the movable cross slide 22 and thus the recess 22.1 are intended to be displaced. As a result, the recess 22.1 remains without effect, the driving pin 2.3 remains in contact with the side face of the cross slide 22 in front of the recess 22.1. The driving pin 2.3 can thus carry the breech 11 along toward the rear. In the continued movement of the breech 11 toward the rear, the movable cross slide 22 and the pin 21 are transferred back into the original position. This can take place by way of slopes 24 (for the cross slide 22) and/or ramps 25 (for the pin 21) etc. incorporated into the main weapon housing or a weapon cradle (FIG. 6). However, if a shot is not fired (for example a dud), the cross slide 22 is not intended to be displaced. As a result, the driving pin 2.3 slides through this recess 22.1, which has now not been displaced. The breech 11 remains in its front, locked position.

Figure 4:
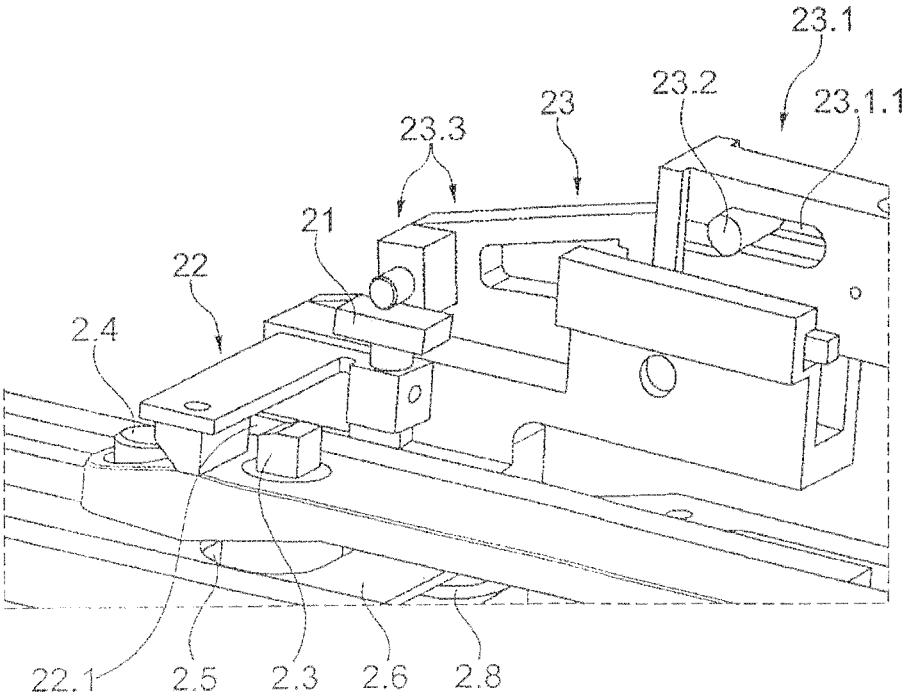
FIG. 4 shows an illustration of an emergency stop device contained in the breech drive.

In order to force the pin 21 out, the kinematic system 23 is provided, which, on account of the weapon recoil when a shot is fired, forces out the pin 21. The kinematic system 23 (FIGS. 4-6) is, as already stated, formed by the guide 23.1 arranged to the side of the overall control slide 12, the connecting rod 23.2 guided in the control curve 23.1.1, and the lever 23.3.

Figure 7B:
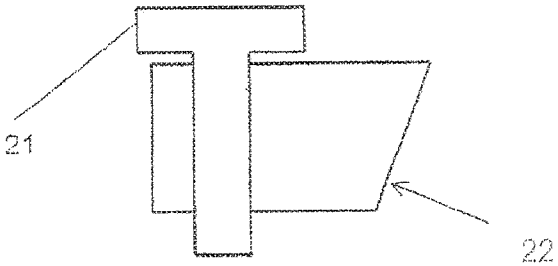

A recoil of the weapon has the effect that the connecting rod 23.2 is guided along the control curve 23.1.1 out of the lower curve region into the upper curve portion, i.e. upward. In the process, the lever 23.3 is pushed onto the pin 21 in a lever movement. The latter is forced out of the overall control slide 12 at the side (FIG. 7*b*) and pushed into the path of the driving pin 2.3 or of the connecting rod shaft 2.1. The displacement of the cross slide 22 takes place by way of the pivoting of the connecting rod shaft 2.1, which, in the region of the groove 2.5 in which the driving pin 2.3 is moved, has a lateral thickened portion with which the connecting rod shaft 2.1 acts on the extended pin 21 of the cross slide 22. The pivotable connecting rod shaft 2.1 carries along the pin 21, and thus the cross slide 22, with its thickened portion.

If there is no recoil of the weapon 10, the kinematic system 23 does not act, and the pin 21 remains in its original position (FIG. 7*a*). The pivotable connecting rod shaft 2.1 slides through under the pin 21, and the cross slide 22 remains in its original position. The driving pin 2.3 reaches, by way of the pivoting, the recess 22.1 in the cross slide 22 and is guided through said recess 22.1. The breech 11 remains in the front position and is not carried along toward the rear.

In a particular embodiment, the driving pin 2.3 of the connecting rod 2 is mounted in the connecting rod 2 in a spring-loaded manner. The movable cross slide 22 additionally has a slope 22.2. This has the advantage that the driving pin 2.3 is guided along the slope 22.2 and can dip under the movable cross slide 22 on account of the spring loading, should the connecting rod continue to run.

Figure 8:
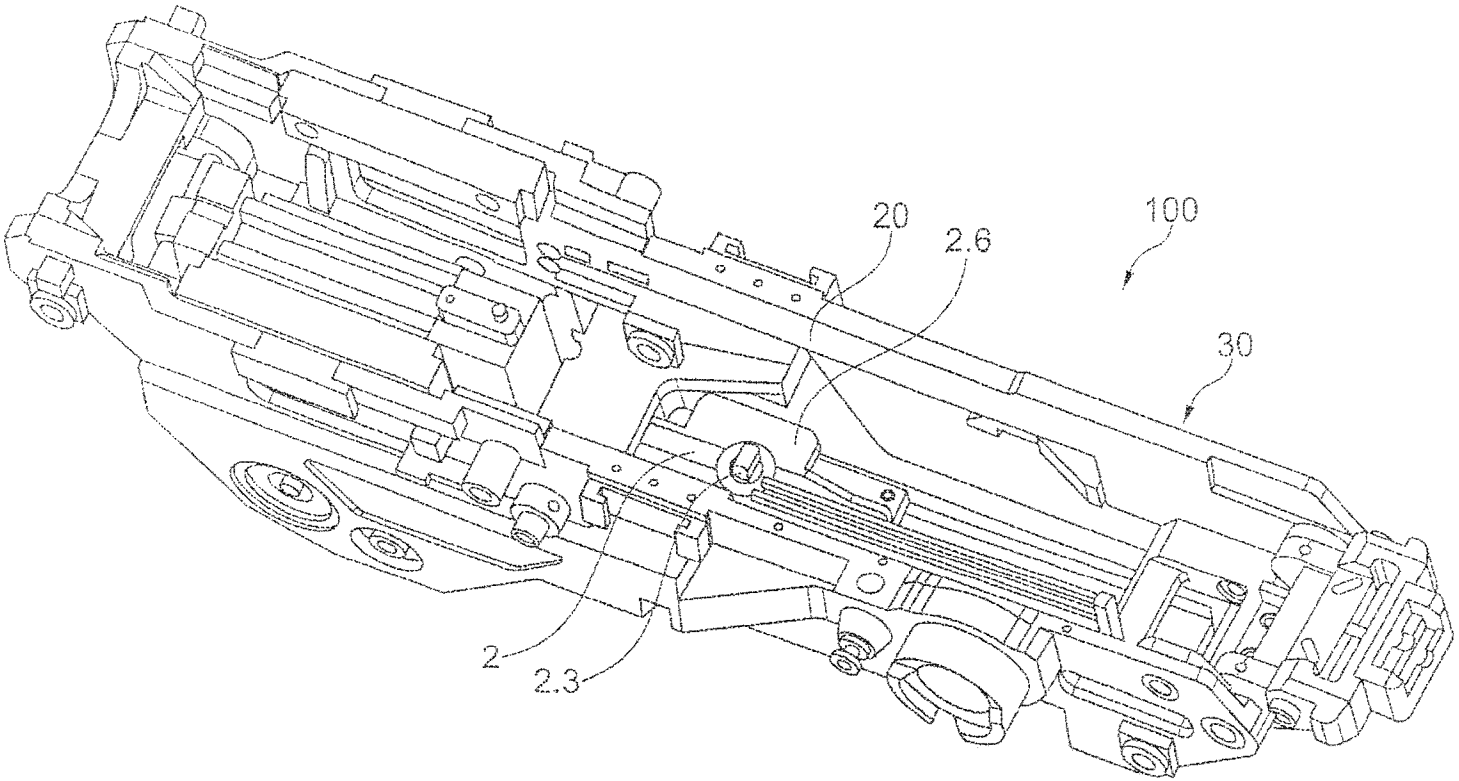
FIG. 8 shows the incorporation of the emergency stop device into a weapon cradle.

FIG. 8 shows one way of incorporating the emergency stop device 20 in a weapon housing 30 of a weapon 100. The incorporation shown here differs from the illustrations in FIGS. 4 to 6 in that, in FIG. 8, the emergency stop device 20 is incorporated in the weapon 100 on the right-hand side, as seen in the firing direction, and on the left-hand side in FIGS. 4 to 6. The local incorporation depends on the direction in which the connecting rod 2 rotates. If it rotates clockwise, the emergency stop device should be installed on the left-hand side. If, however, the connecting rod 2 rotates counterclockwise, the incorporation takes place on the right-hand side.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon drive for a weapon comprising:

a drive curve;

a connecting rod guided in the drive curve, the drive curve includes the firing cycle of the weapon, the connecting rod, in addition to a connecting rod shaft, comprises a front pin and a rear pin as driving pin, the connecting rod engages with its front pin in the drive curve and is guided therein, wherein the front pin is connected to a crank which is driven by an external drive, and the driving pin is connected to an overall control slide of a breech of the weapon and is adapted to engage in a groove-like guide incorporated beneath the overall control slide; and a connecting rod carriage of the connecting rod, wherein the connecting rod is pivoted about a pivot point within the idle times of the breech, which causes the driving pin that runs in a groove in the connecting rod carriage of the connecting rod to pivot, and wherein the connecting rod engages with its driving cam in the groove-like guide in the overall control slide in order to transport the breech.

2. The weapon drive as claimed in claim 1, wherein the connecting rod carriage has four sliding rollers incorporated at the corners of the connecting rod carriage.

3. The weapon drive as claimed in claim 1, wherein the drive curve comprises a front region extending transversely to the breech and a region having a radius, said regions defining idle times of the breech.

4. The weapon drive as claimed in claim 3, wherein the radius is as great as a length of the connecting rod guided in the drive curve.

5. The weapon drive as claimed in claim 1, wherein an overall control slide has a fixed lug and a movable cross slide, wherein, via the fixed lug, the breech is moved forward and the movable cross slide serves to transport the breech back.

6. The weapon drive as claimed in claim 5, wherein the movable cross slide has a recess.

7. The weapon drive as claimed in claim 5, wherein the movable cross slide has a laterally incorporated pin.

8. The weapon drive as claimed in claim 1, further comprising an emergency stop device having at least one kinematic system which forces out the pin when a shot is fired.

9. The weapon drive as claimed in claim 8, wherein the kinematic system is formed by at least one guide, at least one connecting rod guided in a control curve of the guide, and at least one lever.

10. The weapon drive as claimed in claim 1, wherein the driving pin of the connecting rod is mounted in the connecting rod in a spring-loaded manner.

11. The weapon drive as claimed in claim 5, wherein the movable cross slide has a slope.

12. A weapon having a weapon drive as claimed in claim 1.

13. The weapon as claimed in claim 12, wherein slopes or ramps are incorporated into the main weapon housing or into a weapon cradle, said slopes or ramps serving to guide the cross slide and the pin back into their original position.

* * * * *